US007975657B2

(12) United States Patent
Okayasu

(10) Patent No.: US 7,975,657 B2
(45) Date of Patent: Jul. 12, 2011

(54) PORTABLE HEAT TRANSFER APPARATUS

(76) Inventor: Kenji Okayasu, Minato-ku (JP)

( * ) Notice: Subject to any disclaimer, the term of this patent is extended or adjusted under 35 U.S.C. 154(b) by 553 days.

(21) Appl. No.: 11/992,863

(22) PCT Filed: Sep. 29, 2006

(86) PCT No.: PCT/JP2006/319530

§ 371 (c)(1),
(2), (4) Date: Mar. 28, 2008

(87) PCT Pub. No.: WO2007/037408

PCT Pub. Date: Apr. 5, 2007

(65) Prior Publication Data

US 2009/0117505 A1 May 7, 2009

(30) Foreign Application Priority Data

Sep. 29, 2005 (JP) ..... 2005-283469

(51) Int. Cl.
*F22B 1/02* (2006.01)

(52) U.S. Cl. ..... 122/31.1; 122/DIG. 10; 126/110 B; 126/204; 126/210

(58) Field of Classification Search ..... 122/28, 122/31.1, 32, DIG. 10; 126/376.1, 378.1, 126/391.1, 110 B, 110 C, 400; 431/328
See application file for complete search history.

(56) References Cited

U.S. PATENT DOCUMENTS 2,498,362 A * 2/1950 De Lancey ..... 126/110 R
4,602,610 A * 7/1986 McGinnis ..... 126/110 E
4,958,619 A * 9/1990 Kardas ..... 126/85 R
5,282,740 A 2/1994 Okayasu
6,394,042 B1 * 5/2002 West ..... 122/32
(Continued)

FOREIGN PATENT DOCUMENTS

JP 55-18687 Y2 5/1980
(Continued)

OTHER PUBLICATIONS

Russian Agency for Patents and Trademarks, Decision on Grant for Russian Patent Application No. 20081117/40/06(012687), May 18, 2010, Moscow, Russia.

*Primary Examiner* — Gregory A Wilson
(74) *Attorney, Agent, or Firm* — Chapman and Culter LLP

(57) ABSTRACT

The present invention relates to a portable heat transfer apparatus designed to supply heat to an external heat load, such as a space-heating unit or a heating garment, in a manner to be usable in outdoor and other environments where it is difficult to receive a supply of electricity or fuel gas, and allows a ratio of LPG and air to be controlled so as to perform combustion in desirable conditions.

The portable heat transfer apparatus of the present invention is adapted to ignite a mixture supplied from a fuel-gas supply unit and a fuel gas-air air-fuel unit having air-fuel ratio adjustment mechanism, using a piezoelectric ignition unit, so as to induce a flame burning in a combustion chamber of a burner, and drive a heat-drive pump disposed relative to burner while interposing a heat-collecting container therebetween, by heat generated from the flame burning, so as to transfer heat to an external heat load, while controlling the air-fuel ratio adjustment mechanism by using a spring-type timer adapted to be moved by a control lever, or by activating the air-fuel ratio adjusting temperature sensor installed in the heat-collecting container.

16 Claims, 10 Drawing Sheets

U.S. PATENT DOCUMENTS 6,648,635 B2 * 11/2003 Vandrak et al. ..... 432/222

FOREIGN PATENT DOCUMENTS

| | | | |
|---|---|---|---|
| JP | 57-16049 | Y2 | 4/1982 |
| JP | 57-104144 | | 6/1982 |
| JP | 64-019212 | A | 1/1989 |
| JP | 4-347450 | A | 12/1992 |
| JP | 6-29669 | B2 | 4/1994 |
| JP | 9-049628 | A | 2/1997 |
| JP | 9-126423 | A | 5/1997 |
| JP | 3088127 | B2 | 9/2000 |
| JP | 2001-116265 | A | 4/2001 |
| JP | 2004-092772 | A | 3/2004 |
| RU | 2 040 739 | C1 | 7/1995 |
| RU | 2 131 094 | C1 | 5/1999 |
| RU | 2 155 914 | C1 | 9/2000 |
| SU | 1 726 898 | A1 | 4/1992 |

* cited by examiner

PORTABLE HEAT TRANSFER APPARATUS

TECHNICAL FIELD

The present invention relates to a portable heat transfer apparatus designed to be powered by a self-contained energy source to supply heat to an external heat load, such as a space-heating unit or a heating garment, in a manner to be usable in outdoor and other environments where it is difficult to receive a supply of electricity or fuel gas.

BACKGROUND ART

Heretofore, various transportable or portable heaters for use in outdoor environments or the like, such as a gas stove and a hand warmer, have been widely prevalent. These conventional heaters have involved such inconveniences that only a local region of a user's body can be warmed or a level of warmth cannot be controlled. There has also been commercialized one type of portable heater using a battery and incorporating an electrical resistive element distributedly arranged therein to generate heat based on electrical energy from the battery, such as a heating garment and a heating mat. In this type of portable heater, the battery has been apt to fail to supply required heating energy for a sufficient time of period, because a mass/energy density of the battery is not so high even today.

For solution of the above problems, there has been known a garment comprising carrying out catalytic combustion of liquefied petroleum gas (LPG) as an energy source to produce heat which is transferred by means of air convection to warm up a user's body (see, for example, the following Patent Publication 2). In view of difficulty in transferring heat to every corner only by means of air convection, there has also been known a heating apparatus comprising a thermoelectric conversion element installed in a burner, such as a catalytic burner, and a heat-transfer-medium circulation device adapted to be driven by an electromotive force of the thermoelectric conversion element (see, for example, the following Patent Publication 3).

The inventor of the present invention has also previously proposed a portable heat transfer apparatus comprising a heat drive pump incorporated in a catalytic burner and adapted to circulate heated liquid (see the following Patent Publication 1).

A catalytic combustion process in the burner mainly employed in the apparatus disclosed in the above Publication has a characteristic that a combustion reaction can be induced and maintained at a lower temperature than that in flaming combustion, without interruption due to influences of wind and slight fluctuation in an air-fuel ratio. In reality, there exists a problem that, if the reaction is continued at a stoichiometrical air-fuel ratio for a relatively long period of time, a combustion temperature will be increased up to an excessive level for a catalyst, to cause a gradual deterioration in the catalyst.

In order to avoid the above problem, the reaction is performed at a air-fuel ratio set by excluding the stoichiometric air-fuel ratio. However, in cases where the air-fuel ratio is set in a direction for allowing fuel to become richer, imperfect combustion occurs to cause wasteful consumption of fuel and emission of foul-smelling exhaust gas, although ignitability can be improved to provide enhanced operational performance. In cases where the air-fuel ratio is set in a direction for allowing fuel to become leaner, although perfect combustion can be produced to eliminate wasteful consumption of fuel and emit clean exhaust gas, there is a limit to cover an air amount to be increased relative to a decrease in fuel, by an air suction function based on a non-powerful venturi tube. In particular, it is necessary for a catalyst to ensure a relatively large contact area with an air-fuel mixture, causing an increase in flow resistance. Thus, it is required to provide means for generating an extra force in addition to a gas injection force, for example, means operable to rotate a fan using an external power source (e.g., battery) to introduce air. Consequently, an apparatus to be designed as a portable type is liable to become complicated and large-scaled.

[Patent Publication 1] Japanese Patent No. 3088127
[Patent Publication 2] JP 09-126423A
[Patent Publication 2] JP 2001-116265A

DISCLOSURE OF THE INVENTION

Problem to be Solved by the Invention

In view of the above circumstances, it is an object of the present invention to provide a portable heat transfer apparatus designed to burn fuel gas such as LPG and drive a heat-drive pump based on resulting heat so as to heat a liquid and transfer the heated liquid to an external heat load, in such a manner as to allow the entire size of the apparatus to be reduced, and further designed to adequately control and maintain a ratio of air and LPG to be burnt, in such a manner as to allow flaming combustion to be maintained in a stable state, while performing the series of operations in a simple and reliable manner.

Means for Solving the Problem

In order to achieve the above object, as set forth in the appended claim 1, the present invention provides a portable heat transfer apparatus which comprises: a fuel-gas supply unit provided with an LPG supply source and a pressure regulator, and adapted to supply gaseous LPG as fuel gas; a fuel gas-air air-fuel unit provided with a fuel-gas injection nozzle and a venturi tube each operable to operate with the fuel gas, and adapted to mix the fuel gas with air so as to produce a mixture thereof, wherein the fuel gas-air air-fuel unit includes a air-fuel ratio adjustment mechanism adapted to adjust a ratio of the mixture during a start-up and warm-up period; a piezoelectric ignition unit adapted to be activated by moving a control lever; a burner adapted to subject the mixture to flame burning in a combustion chamber thereof, a heat-collecting container disposed to surround the burner; a heat-drive pump joined to the heat-collecting container, and adapted to transfer a liquid heated by heat generated in the burner, to a heat load via a liquid circuit; and a spring-type timer adapted to be moved by the control lever, wherein the air-fuel ratio adjustment mechanism is adapted to be moved in conjunction with the movement of the spring-type timer.

As set forth in the appended claim 2, the present invention also provides a portable heat transfer apparatus which comprises: a fuel-gas supply unit provided with an LPG supply source and a pressure regulator, and adapted to supply LPG as fuel gas; a fuel gas-air air-fuel unit provided with a fuel-gas injection nozzle and a venturi tube each operable to operate with the fuel gas, and adapted to mix the fuel gas with air so as to provide a mixture thereof, wherein the fuel gas-air air-fuel unit includes a air-fuel ratio adjustment mechanism adapted to adjust a air-fuel ratio of the mixture during a start-up and warm-up period; a piezoelectric ignition unit adapted to be activated by moving a control lever; a burner adapted to subject the mixture to flame burning in a combustion chamber thereof; a heat-collecting container disposed to surround the burner; a heat-drive pump joined to the heat-collecting container, and adapted to transfer a liquid heated by heat generated in the burner, to a heat load via a liquid circuit; and a temperature sensor installed in the heat-collecting container, and adapted to be activated in response to a temperature of the heat-collecting container, so as to move the air-fuel ratio adjustment mechanism.

The portable heat transfer apparatus set forth in the appended claim 1 may further comprise a safety unit including: a safety valve provided in a fuel-gas flow passage; means adapted to open the safety valve in conjunction with the spring-type timer during the start-up and warm-up period; and a mechanism adapted to close the safety valve through a temperature sensor adapted to become functional when the heat-collecting container is out of a predetermined temperature range. The portable heat transfer apparatus set forth in the appended claim 1 may include an operating-force amplifying mechanism adapted to amplify an operating force for operating the piezoelectric ignition unit.

The portable heat transfer apparatus set forth in the appended claim 2 may further comprise a safety unit including: a safety valve provided in a fuel-gas flow passage; means adapted to open the safety valve in conjunction with the spring-type timer during the start-up and warm-up period; and a mechanism adapted to close the safety valve through a temperature sensor adapted to become functional when the heat-collecting container is out of a predetermined temperature range. The portable heat transfer apparatus set forth in the appended claim 2 may include an operating-force amplifying mechanism adapted to amplify an operating force for operating the piezoelectric ignition unit and the spring-type timer.

The portable heat transfer apparatus of the present invention may include a vaporizer interposed in a fuel-gas flow passage connecting the LPG supply source and the pressure regulator, and adapted to forcedly vaporize the LPG by heat from the burner. In portable heat transfer apparatus of the present invention, the combustion chamber of the burner may have an internal volume of 10 cc or less. The portable heat transfer apparatus of the present invention may include a porous solid radiation-conversion member installed in the combustion chamber, and adapted to partially convert heat energy into radiation energy. The portable heat transfer apparatus of the present invention may include an ignition-electrode advancing/retracting mechanism adapted, according to an operation of an operating lever, to advance an ignition electrode to protrude into the combustion chamber, and, after a discharging/igniting operation of the ignition electrode, return the ignition electrode to its original position outside the combustion chamber. In this case, the ignition electrode may be disposed to be advanced and retracted at a position on an upstream side of a flow of the mixture relative to a flame front in the combustion chamber.

[Function]

In the present invention, a mixture supplied from the fuel-gas supply unit and the fuel gas-air air-fuel unit having the air-fuel ratio adjustment mechanism is ignited by the piezoelectric ignition unit to produce flame burning in the combustion chamber, and the heat-drive pump provided through the heat-collecting container is driven by heat generated in the combustion chamber in such a manner as to transfer heat to the external heat load. Furthermore, the air-fuel ratio adjustment mechanism may be controlled by using the spring-type timer adapted to be moved by the control lever, or by activating the air-fuel ratio adjusting temperature sensor installed in the heat-collecting container.

BEST MODE FOR CARRYING OUT THE INVENTION

Figure 1:
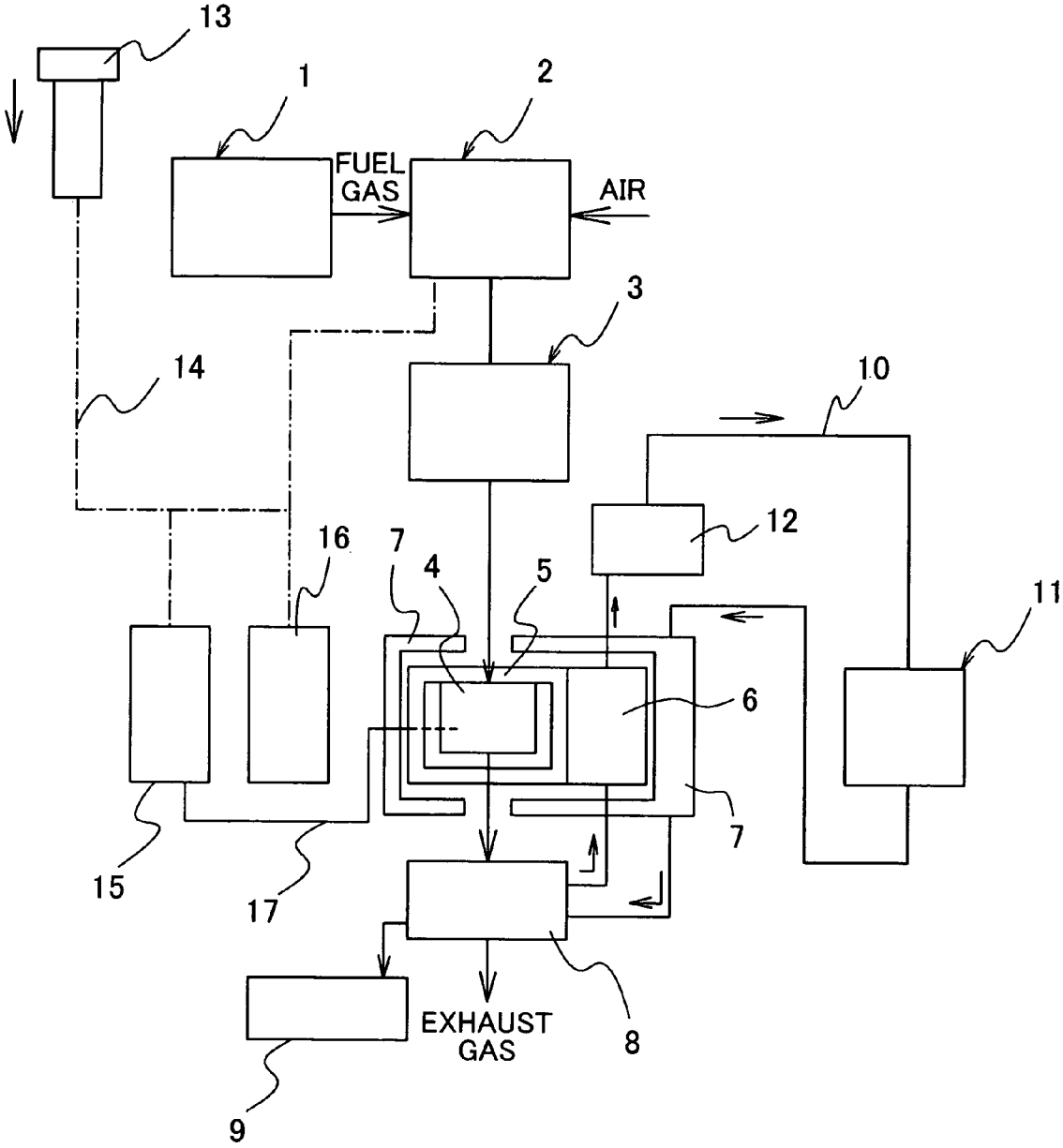
FIG. 1 is a block diagram showing a portable heat transfer apparatus according to a first embodiment of the present invention.

FIG. 1 shows a portable heat transfer apparatus according to a first embodiment of the present invention, wherein the structure thereof is illustrated by a block diagram. The first embodiment corresponds to the invention set forth in the appended claim 1. In FIG. 1, a plurality of blocks are connected by arrowed lines indicating respective flows of fuel gas, air and exhaust gas.

In FIG. 1, the reference numeral 1 indicates a fuel-gas supply unit provided with an LPG cylinder serving as an LPG supply source, a cylinder attaching/detaching device, a fuel-gas supply valve and a fuel-gas pressure regulator, and adapted to supply fuel gas having a given pressure to an after-mentioned fuel-gas nozzle.

In FIG. 1, the reference numeral 2 indicates a air-fuel ratio adjustment mechanism provided with a fuel-gas nozzle and a venturi tube, and adapted to suck air from outside according to injection of the fuel gas, while restricting an amount of the air by an air valve, so as to form a mixture having a given air-fuel ratio, and supply the mixture to a burner via a diffuser. The diffuser 3 is adapted to gradually decelerate the mixture supplied at a high speed so as to convert velocity energy into pressure energy. Thus, a pressure on an upstream side of the burner becomes slightly greater than atmospheric pressure. Based on the pressure difference from atmospheric pressure, exhaust gas resulting from combustion of the mixture will be discharged outside, while overcoming a flow resistance in each exhaust passage.

The burner 4 is made of a material having high heat insulation property and high heat-ray radiation capability, such as ceramics. In the first embodiment, a porous solid radiation-conversion member is housed in a downstream region of a combustion chamber of the burner 4 to partially convert heat energy generated from burning in the combustion chamber, to radiation energy, so as to provide enhanced flame stability. Further, a heat-collecting container 5 made of a heat conductor is disposed to surround the burner 4 with certain level of air layer therebetween. This heat-collecting container 5 is designed to maximally absorb heat generated in the burner 4, and perform heat exchange with exhaust gas so as to heat the mixture by the received heat while cooling the exhaust gas, for example, by means of a mixture inlet portion and an exhaust-gas outlet portion thereof each formed with a large number of holes. In the present invention, a small-sized burner having a combustion chamber with an internal volume, for example, of 10 cc or less, may be used as the burner 4.

A heat-drive pump 6 is disposed such that a heat-receiving portion thereof is in close contact with the heat-collecting container 5 to absorb heat energy from the heat-collecting container 5, and adapted to be driven by the absorbed heat energy. A shield container 7 is disposed to surround the heat-collecting container 5 and the heat-drive pump 6 with a space therebetween, so as to serve as a means to absorb heat radiated from respective wall surfaces of the heat-collecting container 5 and the heat-drive pump 6. Exhaust gas discharged from the heat-collecting container 5 is still in a high-temperature state. A heat exchanger 8 is provided as a means to absorb and utilize heat energy of the exhaust gas. Water vapor contained in the exhaust gas is cooled and condensed by the heat exchanger. A drain tank 9 is provided as a means to accumulate the condensed water. When the drain tank 9 is full, a drain valve will be appropriately opened to discharge the accumulated water outside.

In FIG. 1, a circulation circuit 10 is formed as a closed circuit which is connected to an external heat load 11, such as a heated garment, and then returned to the external heat load 11 via the shield container 7, the heat exchanger 8, the heat-drive pump 6 and a bubble removal tank 12, so as to repeatedly transfer heat to the external heat load 11. The circulation circuit 10 is designed to allow a liquid to be internally circulated according to mobility given by the heat-drive pump 6, so as to efficiently transfer heat generated in the portable heat transfer apparatus of the present invention, to the external heat load 11.

The liquid out of the external heat load 11 is cooled down to the lowest temperature in the illustrated path. This liquid is firstly introduced into the shield container 7, and slightly heated by collected heat. Then, the liquid is introduced into the heat exchanger 8, and, after being further heated by exhaust gas in a high-temperature state, introduced into the heat-drive pump 6. The heat-drive pump 6 is designed to exert a pumping action based on boiling and condensation of the liquid. Thus, the pumping action becomes more active as the liquid to be introduced therein has a higher temperature.

The liquid discharged from the heat-drive pump 6 is introduced into the bubble removal tank 12. The circulation circuit 10 typically has a length reaching several meters, and thereby external air is likely to slightly intrude thereinto, particularly, when a large portion of the circulation circuit 10 is made of plastic or the like. Although such air is dissolved in the liquid to be circulated, it will be partly separated from the liquid as fine air bubbles when the liquid passes through the heat-drive pump 6. If this phenomenon is left without measures, a gaseous portion will be partially created in the circulation circuit 10 to hinder an effective heat transfer to the external heat load 11. Particularly, in a narrowed portion of the circulation circuit 10, the liquid circulation will be hindered by surface tension occurring in an interface between the liquid and the air bubbles. Thus, the portable heat transfer apparatus according to the first embodiment is designed such that, just after air bubbles are generated in the heat-drive pump 6, the air bubbles are removed by the bubble removal tank 12 utilizing buoyancy of air bubbles, so as to allow only the liquid to flow through the circulation circuit 10.

In the above portable heat transfer apparatus, it is necessary to perform a start-up/warm-up operation. Specifically, based on an action of the porous solid radiation-conversion member provided in the burner 4, even gaseous LPG originally having a relatively low combustion speed can be activated to have an increased combustion speed, and perfect combustion can be performed in a relatively small combustion chamber, using a mixture leaner than a stoichiometrical air-fuel ratio. In this case, the action of the porous solid radiation-conversion member becomes stronger as the porous solid radiation-conversion member has a higher temperature. On the other hand, in a mixture set at a air-fuel ratio fairly richer than the stoichiometrical air-fuel ratio, although ignition and flame holding can be achieved even in a relatively small combustion chamber, imperfect combustion will disadvantageously occur. Thus, it is necessary to provide a start-up/warm-up control mechanism operable to maintain the air-fuel ratio at a value richer than the stoichiometrical air-fuel ratio only in a period before the porous solid radiation-conversion member is heated up to a given temperature enough to exert the desired action, and set the air-fuel ratio at a value slightly leaner than the stoichiometrical air-fuel ratio after the porous solid radiation-conversion member is heated up to the given temperature.

This point will be described based on the illustrated embodiment. A control lever 13 is connected to the air-fuel ratio adjustment mechanism 2, an igniting piezoelectric device 15 constituting a piezoelectric ignition mechanism, and a spring-type timer 16, through a mechanical link mechanism 14. The fuel-gas supply valve of the fuel-gas supply unit 1 is firstly opened. The control lever 13 can be manually moved to slightly close the air valve of the air-fuel ratio adjustment mechanism 2 so as to produce a relatively rich mixture optimal to ignition. Then, the spring-type timer 16 is pushed downwardly to compress or stretch a spring so as to accumulate energy. Further, the piezoelectric device 15 is pressed to induce a spark (i.e., electrical discharge) in an electrode 17 exposed to the combustion chamber so as to ignite the mixture. When a user releases his/her hand from the control lever 13, the control lever 13 is returned to its original position according to a spring force of the piezoelectric device 15. However, the mechanical link mechanism 14 connected to the air valve of the air-fuel ratio adjustment mechanism 2 is designed to have a movement for the spring-type timer 16. This spring-type timer 16 has a mechanism utilizing a viscosity of oil or air, and thereby the compressed or stretched spring will slowly recover to its original shape. Then, after passing through a certain dead region, the spring-type timer 16 starts slowly opening the air valve of the air-fuel ratio adjustment mechanism 2, and finally opens the air valve to an optimal position thereof. Within a time period of the opening, the temperature of the burner 4 is increased to allow the porous solid radiation-conversion member to sufficiently exert the desired action, whereby the portable heat transfer apparatus can be operated using a mixture slightly leaner than the stoichiometrical air-fuel ratio. A spring-type timer utilizing an oil damper may be used as the spring-type timer 16.

As mentioned above, in use of the heat transfer apparatus of the present invention, a user can readily start the apparatus only by performing a single operation of the control lever.

Figure 2:
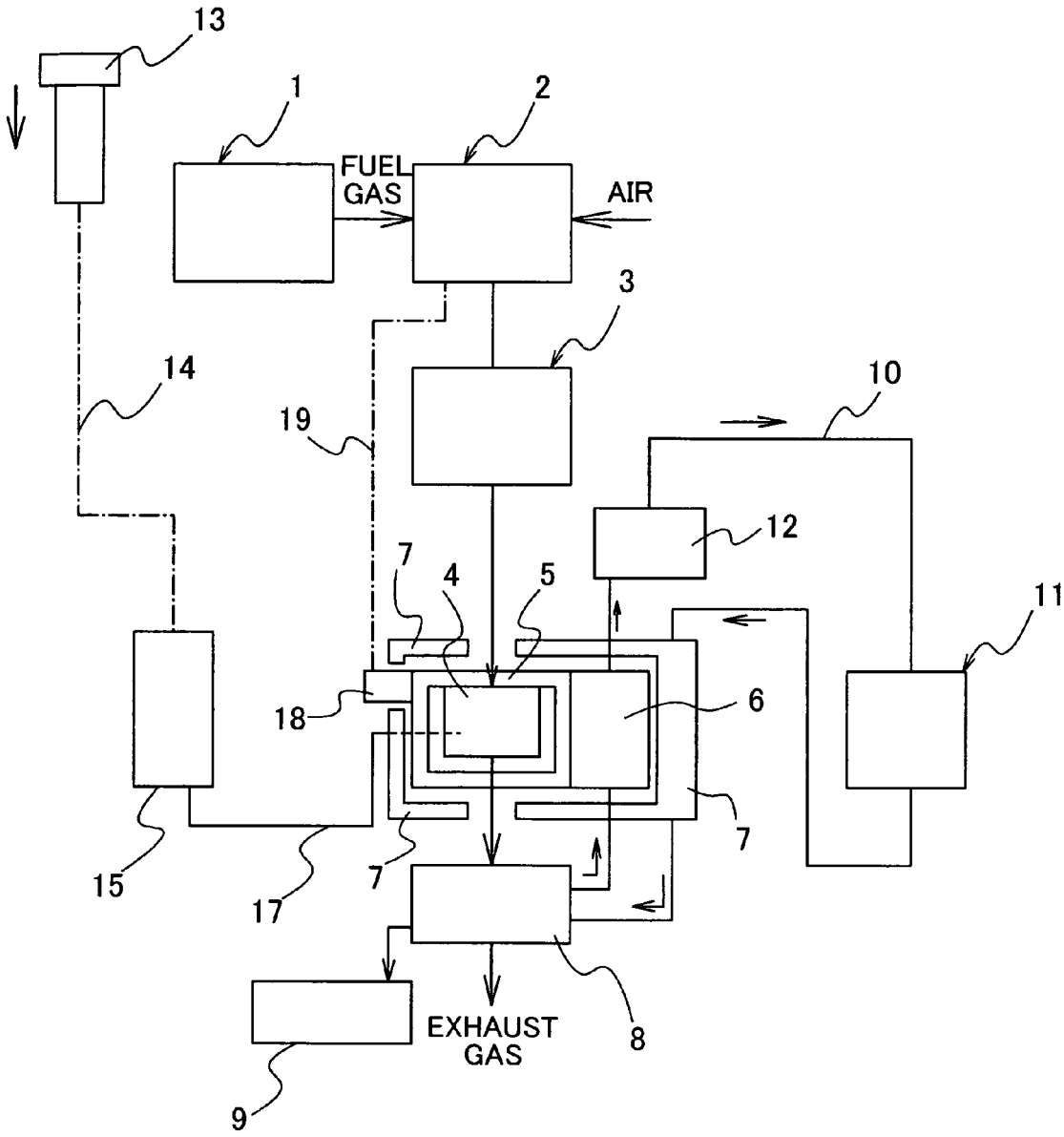
FIG. 2 is a block diagram showing a portable heat transfer apparatus according to a second embodiment of the present invention.

FIG. 2 shows a portable heat transfer apparatus according to a second embodiment of the present invention corresponding to the invention set forth in the appended claim 2, wherein the structure thereof is illustrated by a block diagram in the same manner as that in FIG. 1, and each block defined by the same reference numeral or code as that in FIG. 1 has the same structure and function as those of a corresponding block in FIG. 1.

The following description will be made mainly about a difference from the first embodiment in FIG. 1.

In the second embodiment, a air-fuel ratio adjusting temperature sensor 18 is used, instead of the spring-type timer 16 provided in the first embodiment in FIG. 1. This air-fuel ratio adjusting temperature sensor 18 is disposed to be in close contact with the heat-collecting container 5, and adapted to move the air valve of the air-fuel ratio adjustment mechanism 2 through a sensor-driven link 19 adapted to be moved in response to a temperature sensed by the temperature sensor 18. This temperature sensor 18 may be formed, for example, using a bimetal, a shape-memory alloy, or wax.

An operational mechanism in the second embodiment will be described below. When the heat-collecting container 5 has a relatively low temperature, the air valve is slightly closed, and a mixture is heated up to a temperature suitable for ignition. Then, when the air-fuel ratio adjusting temperature sensor 18 senses, from the heat-collecting container 5, a condition that the temperature of the heat-collecting container 5 is increased as a result of success of ignition, and the temperature of the porous solid radiation-conversion member disposed inside the burner 4 reaches a value capable of exerting its desired function, it operates to slightly open the air valve in a direction opposite to the previous position, whereby the air-fuel ratio is set at a value slightly leaner than the stoichiometrical air-fuel ratio. In this manner, the air-fuel ratio is automatically adjusted between the ignition period and the perfect combustion period. Thus, a user of the heat transfer apparatus can start the apparatus only by pushing the piezoelectric device 15 downwardly using the control lever 1, as with the first embodiment.

Although not described, each of the remaining components other than the air-fuel ratio adjustment mechanism 2 has the same structure and function as those of a corresponding component in the first embodiment.

Figure 3:
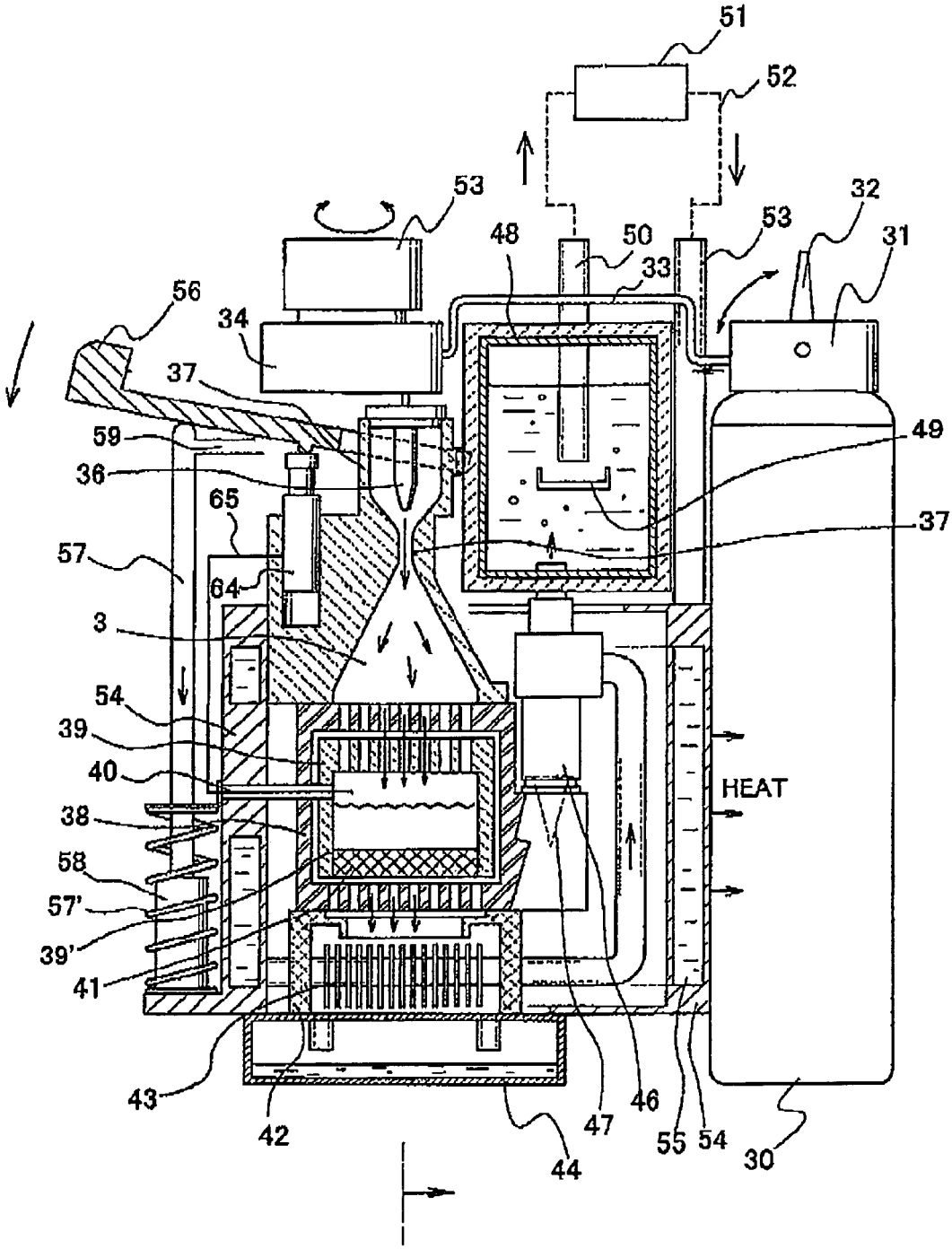
FIG. 3 is a partially-sectional front view showing a portable heat transfer apparatus according to a third embodiment of the present invention.
Figure 4:
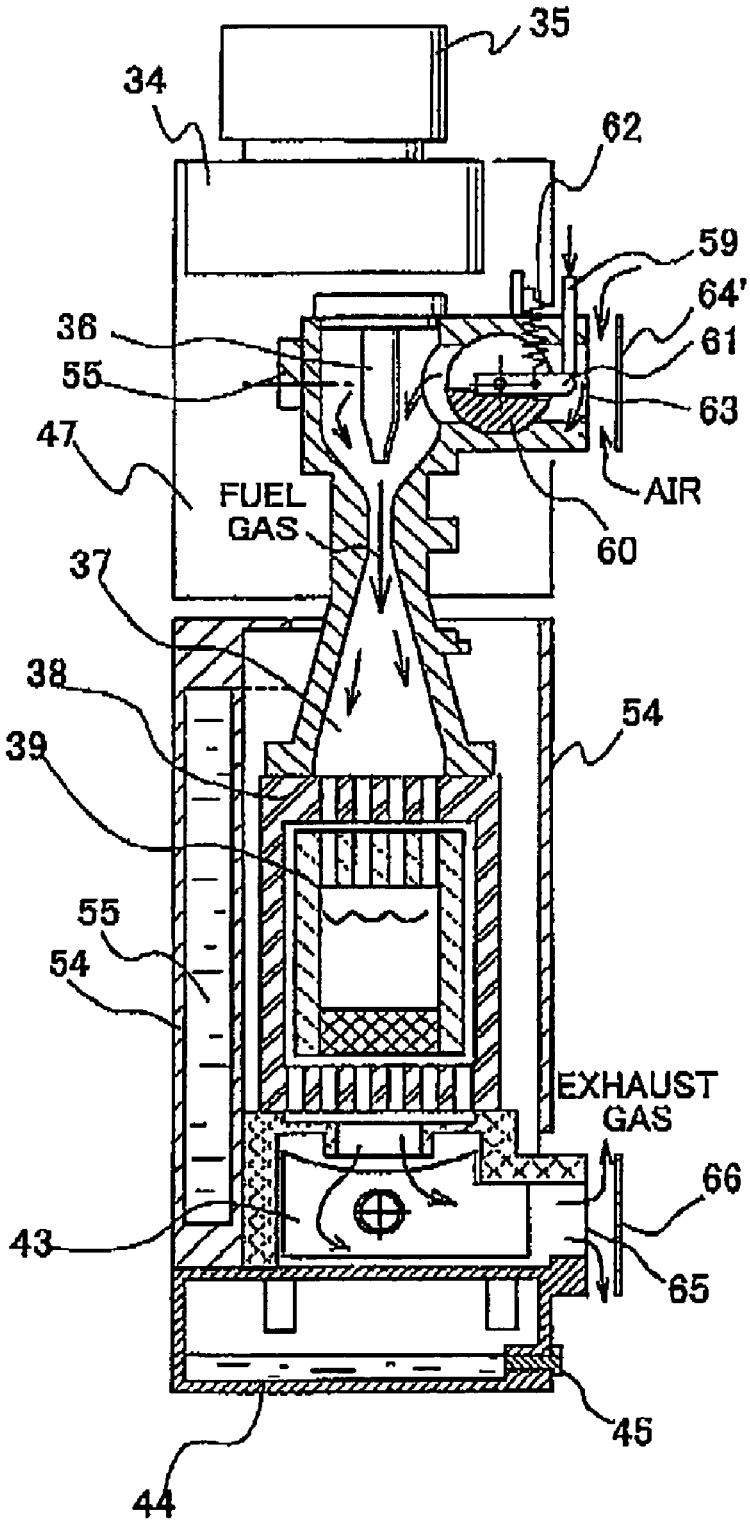
FIG. 4 is a partially-sectional left side view showing the portable heat transfer apparatus according to the third embodiment.
Figure 5:
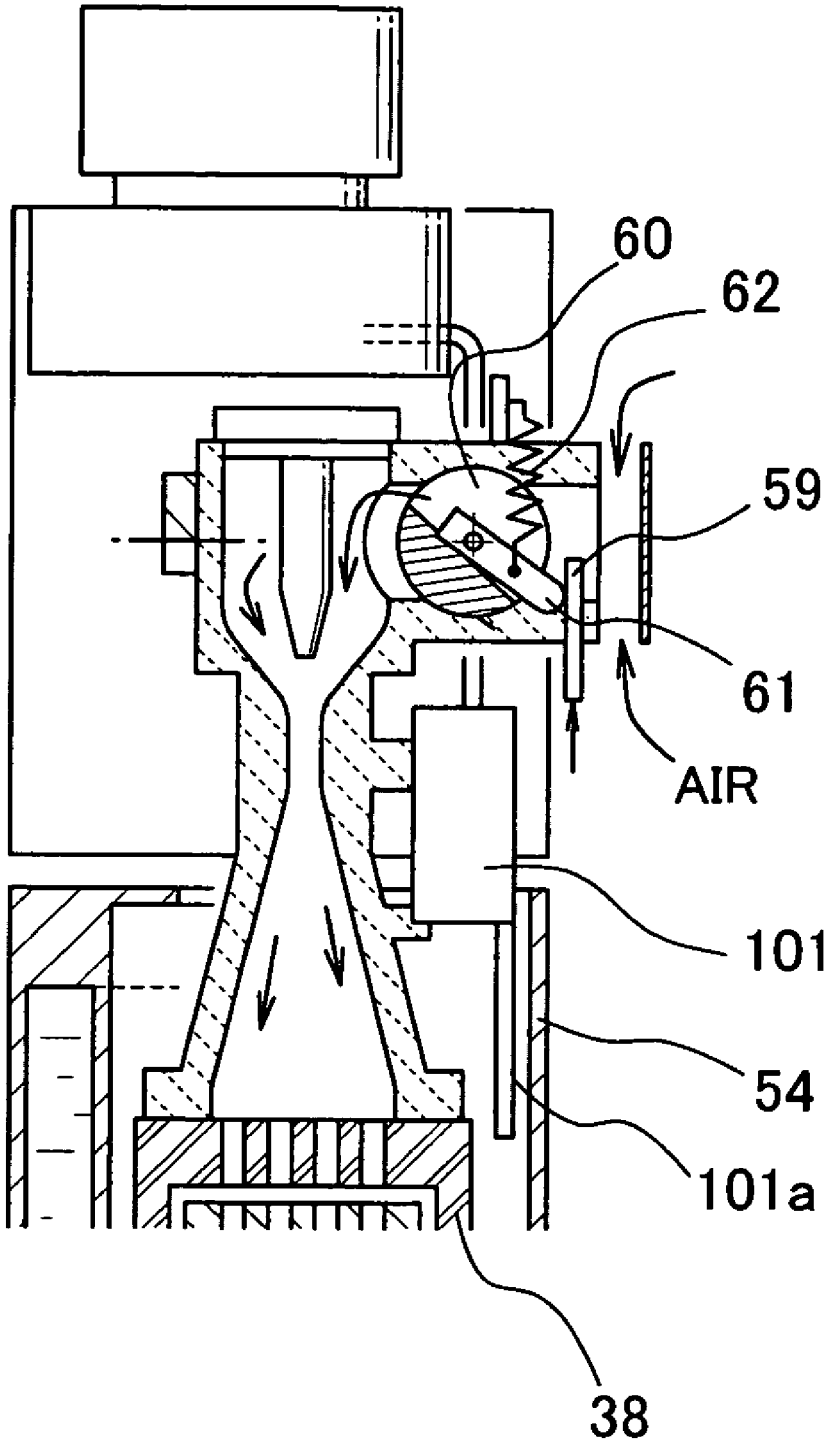
FIG. 5 is a partially-sectional fragmentary enlarged view showing the portable heat transfer apparatus according to the third embodiment.

FIGS. 3 to 5 show a portable heat transfer apparatus according to a third embodiment of the present invention, which is an example more specifically embodying the structure of the first embodiment. FIG. 3 is a partially-sectional front view of the portable heat transfer apparatus. FIG. 4 is a left side view of the portable heat transfer apparatus in FIG. 3, and FIG. 5 is a fragmentary enlarged view of the portable heat transfer apparatus in FIG. 4.

In FIGS. 3 to 5, a fuel-gas supply unit comprises an LPG cylinder 30 serving as an LPG supply source, a cylinder attaching/detaching device 31, a fuel-gas supply valve lever 32, a fuel-gas pipe 33, a pressure regulator 34 connected to the fuel-gas pipe 33, and a knob 35 for adjusting the pressure regulator 34. A fuel gas having a pressure set by the fuel-gas supply-unit is supplied to an air-fuel ratio adjustment mechanism comprising a fuel-gas nozzle 36 and a venturi tube 37. The fuel gas injected from the fuel-gas nozzle 36 sucks air. Then, the fuel gas and the air are formed as a mixture having a certain pressure through a diffuser 3, and the mixture is sent into a burner 39 via a plurality of holes. In the burner 39, the mixture is ignited to form a flame front. A porous solid radiation-conversion member 41 is disposed on a downstream side of a combustion chamber 39' to partially convert heat energy into radiation energy. Thus, a part of energy of exhaust gas is radiated toward the flame front to promote combustion and stabilize a flame. The exhaust gas passing through the porous solid radiation-conversion member 41 is introduced into a heat exchanger 42, and cooled by a large number of fins 43 to cause condensation of water vapor contained therein. The resulting exhaust gas is discharged frontwardly (see FIG. 4), whereas the condensed water in the heat exchanger 42 is accumulated in a tank 44 disposed below the heat exchanger 42, and subsequently drained outside by opening an appropriate drain plug 45 (see FIG. 4). For example, the fuel-gas nozzle 36 used in the third embodiment preferably has an inner diameter of about 40 to 60 micrometers, and a pressure to be applied to the fuel-gas nozzle 36 is preferably set at about $2.9\times10$ to $19.6\times10^4$ Pa (gauge pressure). Preferably, a single or plural-ply wire mesh having a mesh size of No. 80 to No. 40 is used as the porous solid radiation-conversion member 41. Alternatively, a metal having a ceramic coating, or a fine ceramics, may also be used.

A heat-drive pump 46 has a conical-shaped cavity 47 adapted to generate air bubbles, and a heat-receiving portion joined to a heat-collecting container 38 in a fitted manner to facilitate heat conduction from the heat-collecting container 38. In the illustrated embodiment, a liquid discharged from the heat-drive pump 46 is introduced into a bubble removal tank 48. This bubble removal tank 48 is designed to allow fine air bubbles to be accumulated in an upper space thereof while preventing the air bubbles from entering an outlet pipe 50. As shown in FIG. 3, the bubble removal tank 48 is preferably surrounded by a heat insulating material to reduce heat escape. The heated liquid is transferred to an external heat load 51, and, after being cooled by the external heat load 51, sent to a suction pipe 53 and a shield container 54 via a circulation circuit 52. The shield container 54 is made of a heat conductor, wherein the liquid passes through an internal cavity 55 thereof while drawing heat from the internal cavity 55, and then flows into a heat exchanger 42 from a lower left (in FIG. 3) position thereof. The liquid is heated up to a higher temperature through the heat exchanger 42, and then introduced into the heat-drive pump 46. In the third embodiment, the shield container 54 is disposed to be in close contact with the LPG cylinder 30 so as to prevent an internal pressure of the LPG cylinder 30 from being lowered due to a decrease in temperature of LPG.

In an operation of starting the portable heat transfer apparatus according to the third embodiment, the fuel-gas supply valve lever 32 is moved to open a fuel-gas supply valve so as to allow fuel gas to be injected from the fuel-gas nozzle 36. A control lever 56 is designed to form a leverage mechanism so as to reduce an operating force thereof. When the control lever 56 is pushed downwardly, a push rod 57 in contact with the control lever 56 is pushed downwardly against an action of a spring 57' connected to the push rod 57, to set an oil damper 58 in its activated state. The push rod 57 is provided with an arm plate 59 which is arranged to extend rightwardly (see FIG. 4), and adapted to push a rotatable arm 61 connected to a rotary-type air valve 60, downwardly. Specifically, when the rotatable arm 61 is pushed downwardly, the air valve 60 is rotated in a clockwise direction to narrow an air flow passage so as to restrict an air amount, whereby a mixture is adjusted at a rich air-fuel ratio optimal to ignition. A counter spring 62 illustrated in FIG. 4 is a tension spring which has one end attached to the arm plate 59 and the other end attached to an upper portion of an intake port 63, and generates a moment acting to constantly rotate the air valve 60 in a counterclockwise direction.

In conjunction with the pushing-down of the control lever 56, a piezoelectric device 64 is also compressed to generate a high voltage, and the high voltage is led to an ignition plug 40 through a lead wire to produce a sparking in an electrode inside the burner 39 so as to ignite the mixture.

When a user releases his/her hand from the control lever 56, the control lever 56 is returned to its original position by a spring force of the piezoelectric device 64. In contrast, the push rod 57 is not immediately returned to its original position due to the oil damper 58, but slowly returned to the original position (by taking about two minutes). FIG. 5 shows this situation, wherein until the arm plate 59 is moved to an uppermost position, the air flow passage is maintained in a state of being narrowed by the air valve 60 to keep the mixture at the rich air-fuel ratio. Then, when the oil damper 58 is fully stretched, the arm plate 59 is moved to the uppermost position to allow the air valve 60 to be rotated in the counterclockwise direction by the counter spring 62, whereby the air flow passage is expanded to supply a mixture slightly leaner than the stoichiometrical air-fuel ratio, to the burner 39. At this timing, the porous solid radiation-conversion member 41 in the burner 39 has already been heated up to a sufficiently high temperature to provide a stabilized flame.

An intake-port wind-protection plate 64' illustrated in FIGS. 4 and 5 is adapted to prevent wind from directly blowing in the intake port 63. A pressure to be generated by the venturi tube 37 and the diffuser 3 is less than a pressure of wind. Thus, the intake-port wind-protection plate 64' is provided as a means to prevent the flame from being blown out by the wind pressure. In order to prevent a similar phenomenon, an exhaust-port wind-protection plate 66 is provided to an exhaust port 65. As shown in FIG. 4, the two wind-protection plates 64', 66 are arranged to be oriented in the same direction relative to the apparatus. The reason is that, when they are oriented in the same direction relative to wind directing thereto, no difference in wind pressure occurs therebetween. Further, as shown in FIG. 4, they can be disposed with an adequate distance therebetween to advantageously prevent a resonance phenomenon due to flame noise.

Figure 6:
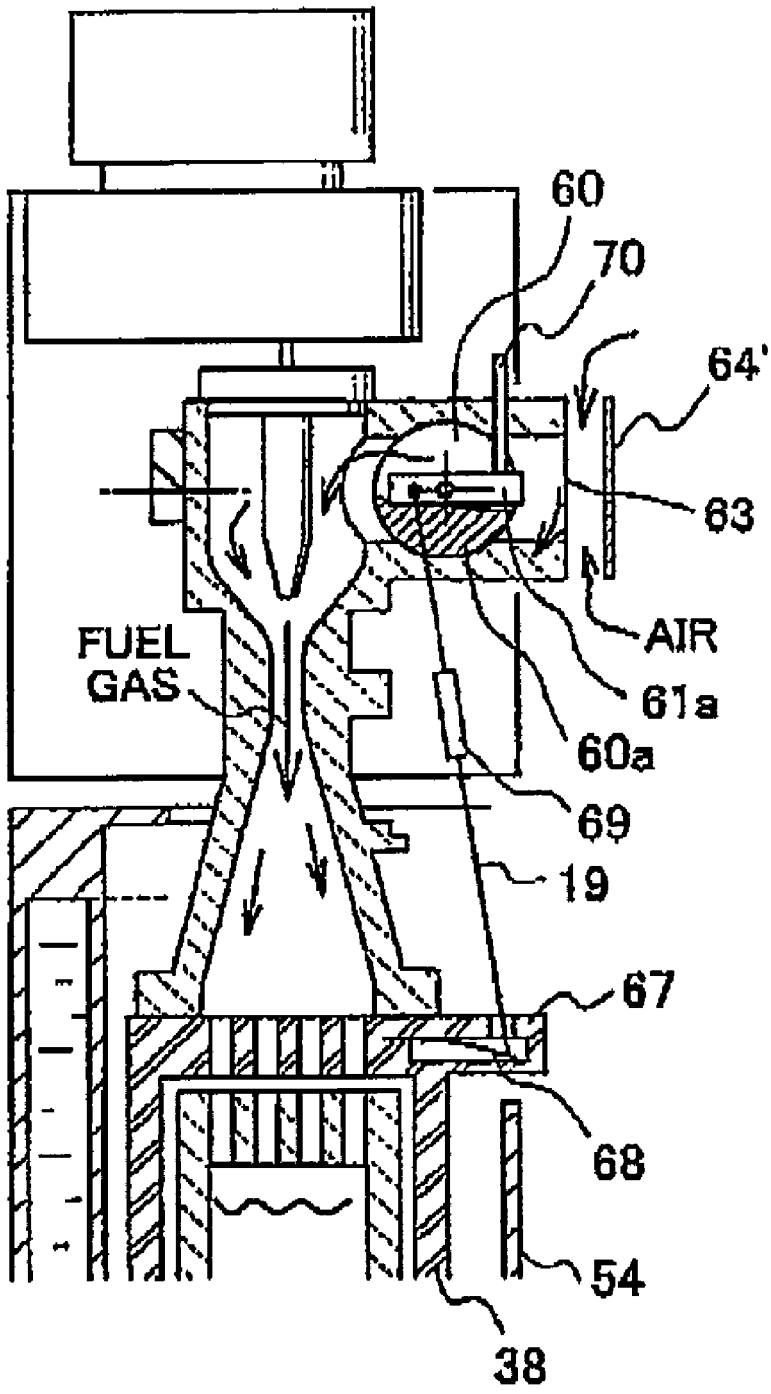
FIG. 6 is a partially-sectional fragmentary enlarged view showing a region corresponding to FIG. 5, in a portable heat transfer apparatus according to a fourth embodiment of the present invention.

FIG. 6 shows a portable heat transfer apparatus according to a fourth embodiment of the present invention, which is an example more specifically embodying the structure of the second embodiment (see FIG. 2). FIG. 6 shows only a distinctive part of the portable heat transfer apparatus, and a fundamental structure of the portable heat transfer apparatus takes on the structure illustrated in FIG. 2.

In the fourth embodiment, a plate-shaped bimetal 68 prepared to have approximately the same properties as those of the heat-collecting container 38 is used as an air-fuel ratio adjusting temperature sensor, and a bimetal-receiving portion 67 receiving therein the plate-shaped bimetal 68 is disposed to be in close contact with the heat-collecting container 38. The plate-shaped bimetal 68 is connected to a rotary-type air valve 61*a* through a sensor-driven link 19. FIG. 6 shows a steady state in which the air valve 60*a* is opened to set an air-fuel ratio at a value slightly leaner than a stoichiometrical air-fuel ratio. In this state, the plate-shaped bimetal 68 is bent due to heat received from the heat-collecting container 38. In a start-up and warm-up period, the heat-collecting container 38 is in a cooled state, and thereby the plate-shaped bimetal 68 is flattened to rotate the air valve 60*a* in a clockwise direction through the sensor-driven link 19, whereby an air flow passage is narrowed to restrict an amount of suction air so as to create a rich mixture.

In the above manner, the air-fuel ratio is automatically controlled depending on the temperature of the heat-collecting container 38. A link adjustment feature 69 is provided as a means to change a length of the sensor-driven link 19 so as to finely adjust the air-fuel ratio of the mixture required for the burner 4. A stopper 70 is provided as a means to prevent the air valve 60*a* from being excessively opened.

Figure 7:
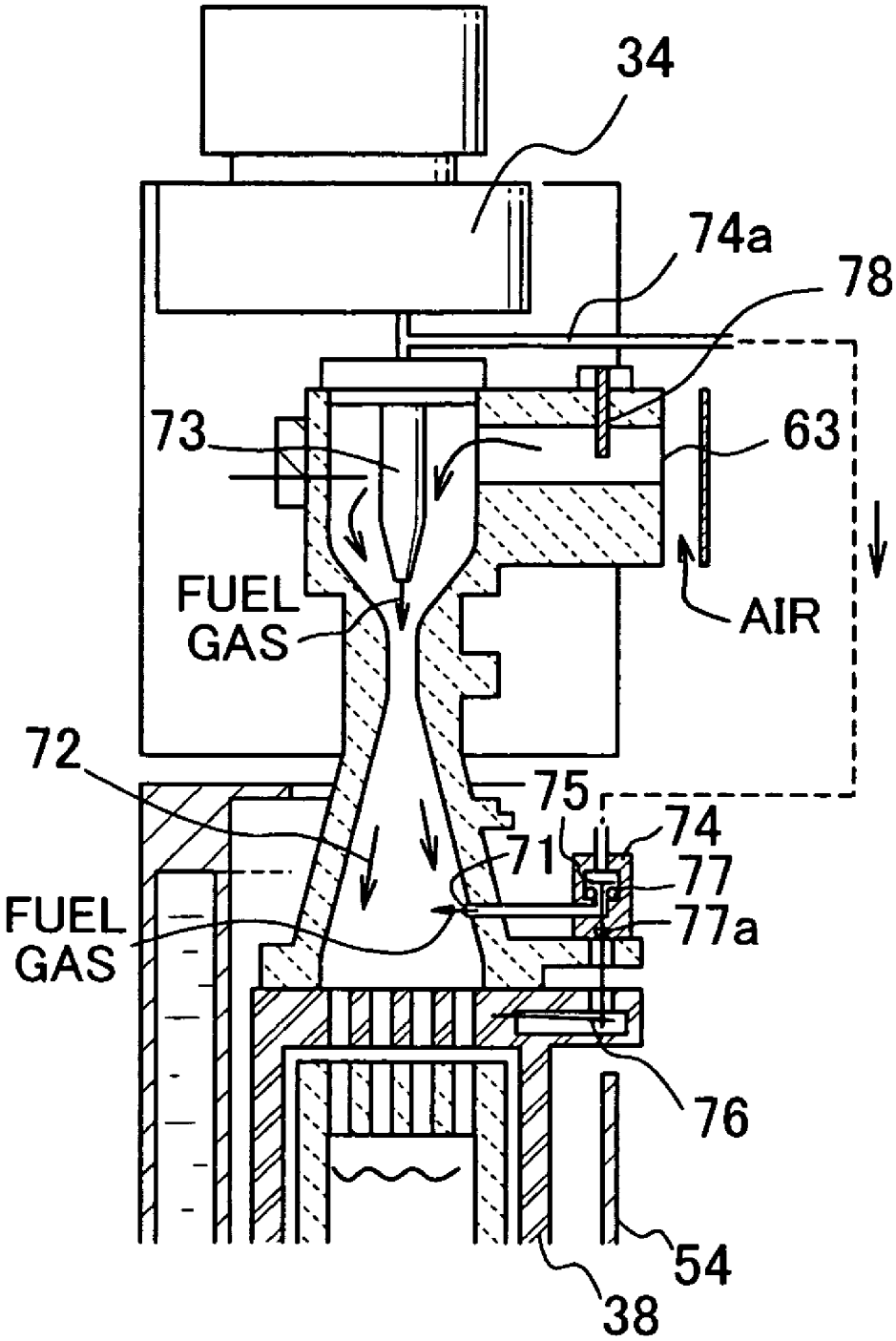
FIG. 7 is a partially-sectional fragmentary enlarged view showing a region corresponding to FIG. 5, in a portable heat transfer apparatus according to a fifth embodiment of the present invention.

FIG. 7 shows a portable heat transfer apparatus according to a fifth embodiment of the present invention, which is an example where a part of the structure of the third embodiment is modified, specifically, an example of modification of the structure illustrated in FIG. 6.

Means for changing the air-fuel ratio of the mixture can be achieved by changing a fuel-gas amount while maintaining an air amount at a constant value, in addition to the technique of restricting the air amount by a valve. Specifically, as shown in FIG. 7, an auxiliary nozzle 71 other than the aforementioned fuel-gas nozzle 73 is installed at a position on a downstream side relative to the venturi tube 3, to inject gaseous LPG at an angle perpendicular to a mixture flow 72. This fuel-gas injection from the auxiliary nozzle 71 makes it possible to additionally supply a given amount of fuel gas without adverse effects on an air suction force of the fuel-gas nozzle 73, so that the air-fuel ratio becomes richer because the air amount is maintained at a constant value. In addition, the fuel-gas injection from the auxiliary nozzle 71 advantageously has an action of sufficiently agitating the mixture. A blanch pipe 74*a* branched from a pipe connecting the pressure regulator 34 to the fuel-gas nozzle 73 may be connected to a control valve 74 to supply fuel gas to the auxiliary nozzle 71.

A plate-shaped bimetal 76 illustrated in FIG. 7 is installed in a space provided in a portion formed to protrude from the heat-collecting container 38. Thus, the temperature of the plate-shaped bimetal 76 becomes approximately equal to that of the heat-collecting container 38. This makes it possible to sense the temperature of the heat-collecting container 38 with a higher degree of accuracy. The control valve 74 has an internal valve element 75 connected to the plate-shaped bimetal 76. FIG. 7 shows a state when the temperature of the heat-collecting container 38 is relatively low, wherein the plate-shaped bimetal 76 is flattened, and thereby the control valve 74 is opened to allow fuel gas to be injected from the auxiliary nozzle 71. When the mixture is ignited in this state, and the temperature of the heat-collecting container 38 is gradually increased, a right end of the plate-shaped bimetal is bent downwardly, and the valve element 75 is moved downwardly along with the downward bending to reduce the fuel-gas amount. When the temperature of the heat-collecting container 38 is further increased, the valve element 75 is brought into close contact with an O-ring 77 to close the control valve 74, whereby the fuel-gas injection from the auxiliary nozzle 71 is stopped to set the mixture ratio at a value slightly leaner than the stoichiometrical air-fuel ratio so as to achieve perfect combustion. In FIG. 7, the reference numeral 78 indicates an air-amount fine-adjustment plate adapted to be pre-adjusted to allow the mixture ratio to be set at a value slightly leaner than the stoichiometrical air-fuel ratio, based on a suction force from the side of the fuel-gas nozzle 73.

Figure 8:
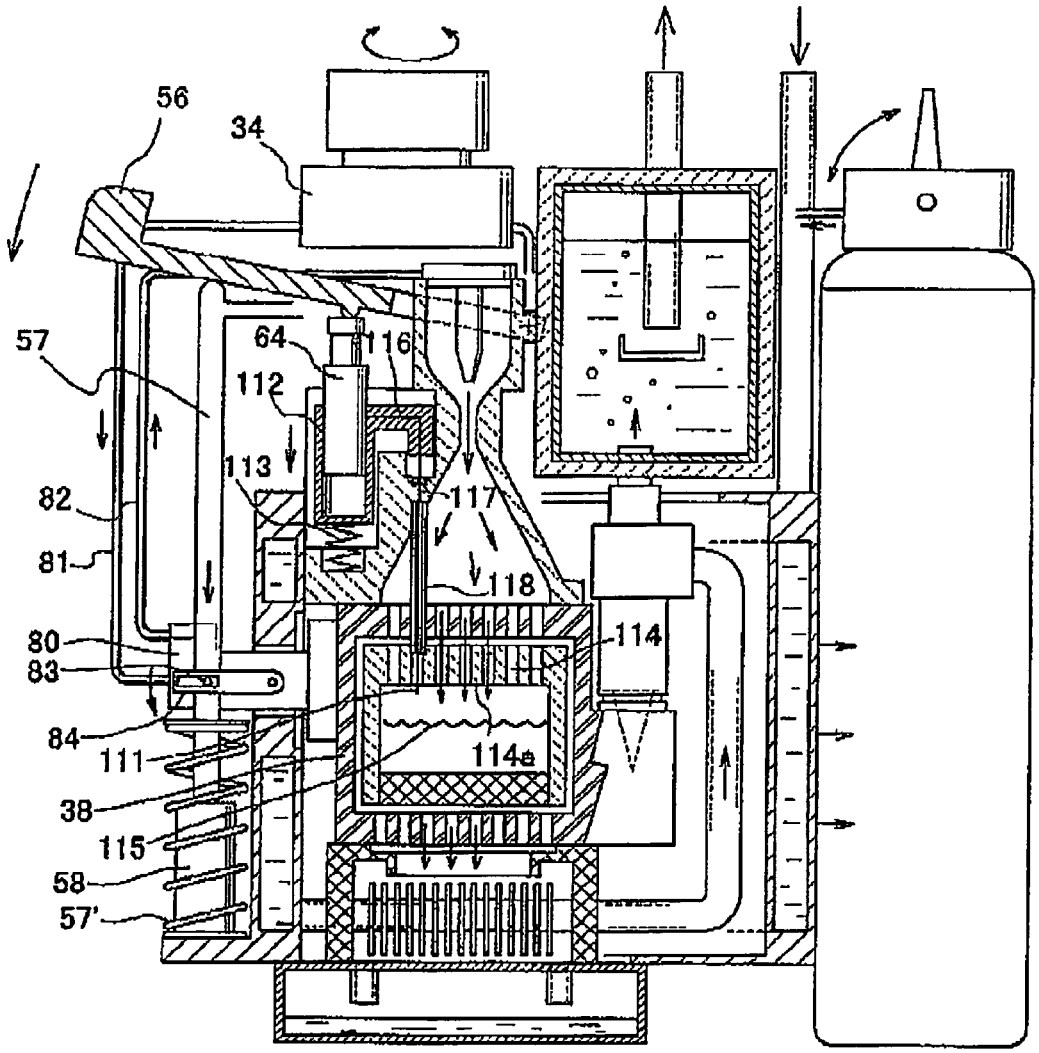
FIG. 8 is a partially-sectional front view showing a portable heat transfer apparatus according to a sixth embodiment of the present invention.
Figure 9:
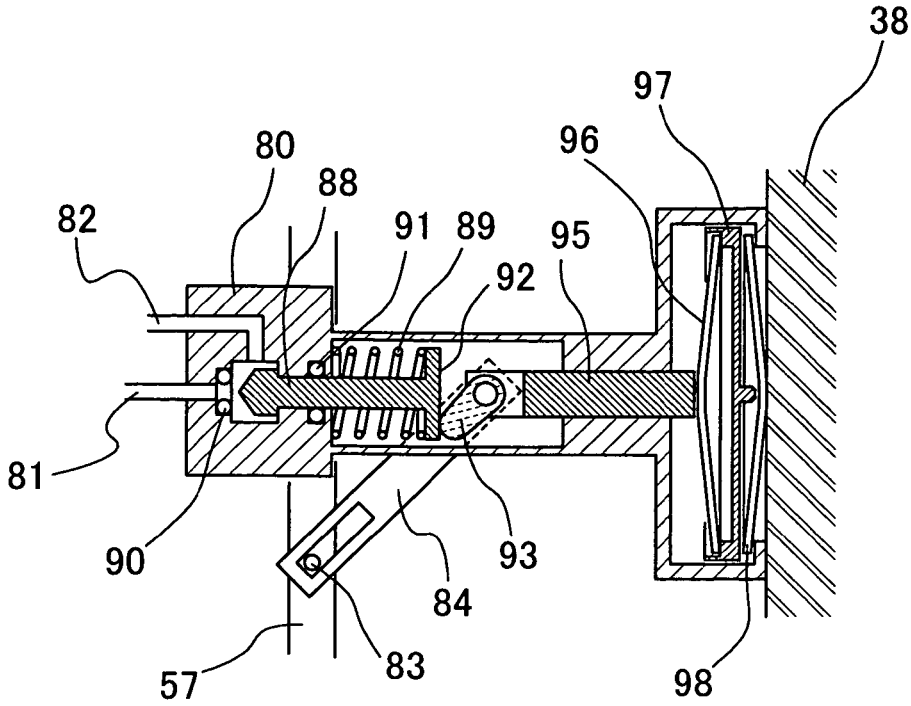
FIG. 9 is a fragmentary enlarged sectional view showing the portable heat transfer apparatus according to the sixth embodiment.
Figure 10:
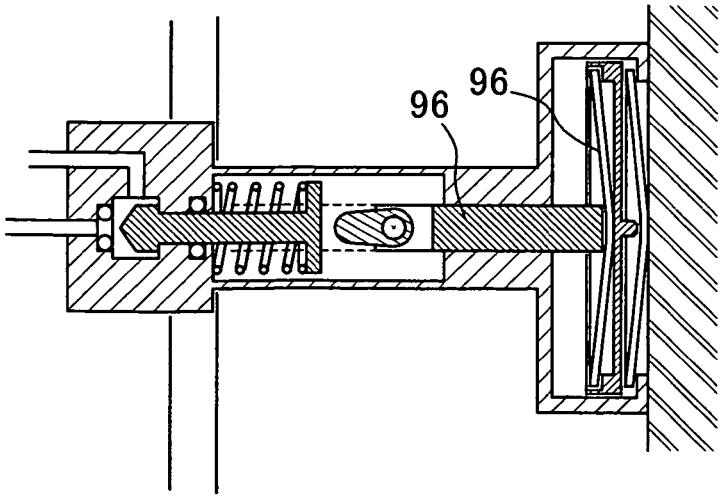
FIG. 10 is a fragmentary enlarged sectional view showing the portable heat transfer apparatus according to the sixth embodiment.

FIGS. 8 to 10 show a portable heat transfer apparatus according to a sixth embodiment of the present invention, which is an example where a safety unit 80 is incorporated in the structure of the third embodiment.

In the present invention, combustion is performed in a combustion chamber defined inside the apparatus, and thereby there is a negative side causing difficulty in determining whether flame is maintained in a safe state. From this point of view, the portable heat transfer apparatus according to the sixth embodiment incorporates a safety unit. This safety unit has a function of stopping a supply of fuel gas to interrupt combustion when a temperature of a burner is excessively increased for some reason, and stopping the supply of fuel gas when flame is blown out due to a gust of wind and when a non-ignition state continues despite an ignition operation.

The safety unit 80 is installed in a fuel-gas flow passage at a position between the LPG cylinder 30 and the fuel-gas nozzle 36, particularly preferably at a position adjacent to the fuel-gas nozzle 36. The safety unit 80 comprises a safety valve including a valve element 88 which constantly receives a biasing force from a spring 89 in a rightward (in FIGS. 8 to 10) direction, and a valve seat composed of an O-ring 90. The safety valve is designed to receive fuel gas from the pressure regulator 34 via a fuel-gas pipe 81, and supply the fuel gas to the fuel-gas nozzle 36 via a fuel-gas pipe 82. The valve element 88 is adapted, when a distal end thereof is brought into contact with the O-ring 90, to close the safety valve so as to block a fuel-gas flow from the fuel-gas pipe 81 to the fuel-gas pipe 82. The safety unit includes a temperature sensor which comprises two disc-shaped bimetals 96, 98, called "snap disc", disposed on respective opposite sides of a disc plate 97 in a superimposed manner and in a bowl-shaped configuration. While the disc plate 97 is disposed between the disc-shaped bimetals 96, 98 in the illustrated embodiment, it is understood that the disc plate may be omitted. Each of the bimetals is adapted to be deformed to a reversed configuration a certain different preset temperature, wherein the bimetal 96 serves as a low-temperature bimetal, and the bimetal 98 serves as a high-temperature bimetal. As shown in FIGS. 9 and 10, a body of the safety unit housing the disc-shaped bimetals 96, 98 is attached to the heat-collecting container 38 in a close-contact manner.

A swing arm 84 is operatively connected to the push rod 57 in such a manner that a pin 83 connected to the push rod 57 is inserted into an elongate hole formed in one end of the swing arm 84. The other end of the swing arm 84 is connected to a cam 93 adapted to come into contact with a bottom surface of the valve element 88, through a pin 94. The pin 94 is rotatably attached to a press rod 95 extending from the disc-shaped bimetal 96.

With a focus on FIGS. 9 and 10, the safety unit used in the portable heat transfer apparatus according to the sixth embodiment will be more specifically described. FIG. 9 shows a state of the safety unit during start-up and warm-up of the portable heat transfer apparatus, wherein the heat-collecting container 38 is still in a low-temperature state. Before a start-up operation, the push rod 57 is located at the uppermost position, and therefore the swing arm 84 is placed in an approximately horizontal posture, whereby the cam 93 presses the valve element 88 toward the valve seat so as to close the safety valve. When the control lever 56 is pushed downwardly, the push rod 57 is moved downwardly against the spring 57' to set the oil damper 58 in the activated state. Thus, the swing arm 84 is rotated in a counterclockwise direction to release the cam 93 from the bottom surface of the valve element 88 so as to allow the valve element 88 to be moved to its closed position by the spring 89, whereby fuel gas flows toward the fuel-gas nozzle 36. During a certain period where the oil damper 58 is maintained in the activated state, a start-up operation for igniting a mixture and a warm-up operation (several minutes) for ensuring stability of the mixture and perfect combustion are performed. At a time when the push rod 57 is returned to its original position by the action of the spring 57' and the oil damper 58 is fully stretched to allow the swing arm 84 to be placed in the approximately horizontal posture, the heat-collecting container 38 is heated up to a high temperature, and thereby the low-temperature disc-shaped bimetal 96 is deformed to have the reversed configuration, whereby the cam 93 is moved away from the bottom surface 92 of the valve element 88 together with the press rod 95 to maintain the fuel-gas flow. In this period, if the ignition fails or flame goes out, the disc-shaped bimetal 96 is not deformed to the reversed configuration, or returned to its original configuration even if it is deformed, whereby the valve element 88 of the safety unit is closed to stop the fuel-gas flow.

Furthermore, if the temperature of the heat-collecting container 38 is increased up to a value greater than the preset temperature of the high-temperature disc-shaped bimetal 98 for some reason, the disc-shaped bimetal 98 is deformed to the reversed configuration to close the safety valve. In this manner, the fuel-gas flow is interrupted in a temperature range other than a certain allowable temperature range of the heat-collecting container 38 to allow the portable heat transfer apparatus to be used within the allowable temperature range.

As with the aforementioned embodiments, the damper 58 can be used for controlling the air valve 60 through the push rod 57 (see FIG. 6).

FIG. 10 shows the safety unit in a state when the portable heat transfer apparatus is in a normal operation state, wherein the swing arm 84 is placed in the approximately horizontal posture. In this state, if flame goes out, the temperature of the heat-collecting container 38 is lowered. Then, when the low-temperature disc-shaped bimetal 96 becomes equal to or less than the preset temperature, it is returned to the original configuration, whereby the cam 93 presses the valve element 88 leftwardly toward the valve seat to interrupt the fuel-gas flow.

As above, the two disc-shaped bimetals 96, 98 different in preset temperature are used in a superimposed manner and in a bowl-shaped configuration. This makes it possible to achieve measures for flame-out and overheat of the apparatus, in a simple mechanism based on a differential movement of the two disc-shaped bimetals 96, 98. In addition, the safety unit makes it possible to avoid a risk caused by a failure of ignition during the start-up period.

Figure 11:
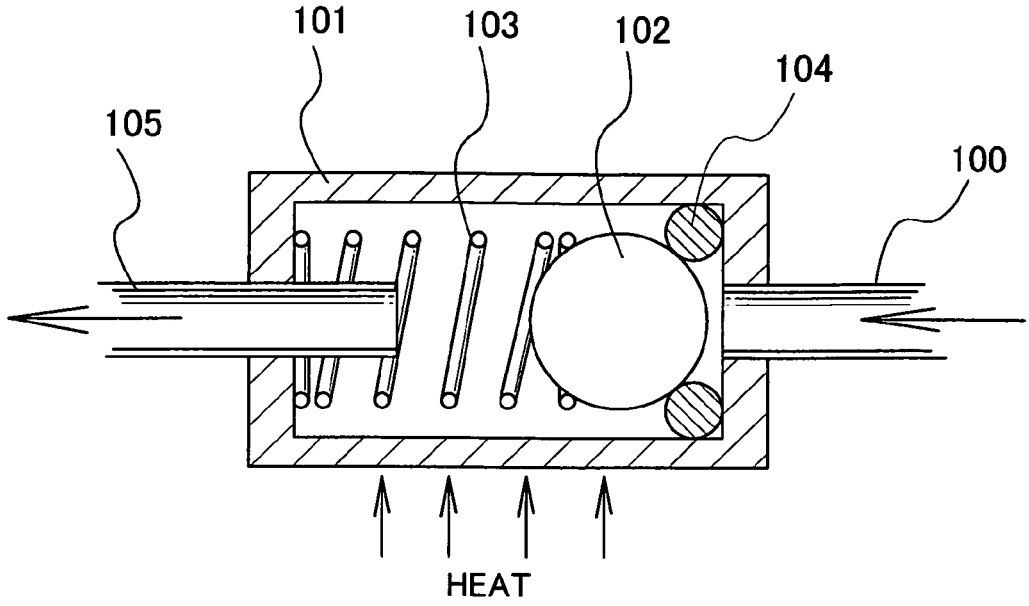
FIG. 11 is a sectional view of a vaporizer for use in a portable heat transfer apparatus of the present invention.

FIG. 11 shows one example of a vaporizer for use in the portable heat transfer apparatus of the present invention.

The portable heat transfer apparatus of the present invention can be downsized and used for various purposes. In use of an LPG cylinder serving as an LPG supply source, when the cylinder is inclined or turned upside down, liquid LPG is likely to flow out of the cylinder and reach the fuel-gas nozzle 36 (see FIG. 3). In this case, the ratio of fuel gas and air will become significantly rich to cause imperfect and unstable combustion. In order to avoid this undesirable situation, this example is intended to warm up a vaporizer using a part of combustion heat so as to forcedly vaporize the LPG.

This vaporizer is preferably installed in the fuel-gas flow passage at a position between the LPG cylinder and the pressure regulator, and may be designed to be maintained at a temperature greater than that of the LPG by 20 to 30° C.

Referring to FIG. 11, a pipe 100 on a right side in FIG. 11 is connected to the LPG cylinder. When the LPG is supplied to a vaporizer body 101 from a right side thereof, a ball valve element of a check valve located at a closed position in a state of being pressed against an O-ring 104 by a spring 103 just before supply of the LPG is moved to an open position according to a pressure difference to allow the LPG to be introduced in an internal space of the body 101. This body designed to receive heat received from therebelow is warmed up to a temperature greater than that of the LPG by about 20° C., and thereby the introduced LPG is immediately vaporized. In this operation, a vapor pressure of the internal space of the body 101 is increased by a value corresponding to the temperature greater than that of the LPG by about 20° C., and the ball valve element is returned to its original position to close the check valve so as to stop the introduction of the liquid LPG. Then, the vaporizer supplies fuel gas toward the pressure regulator via a pipe 105 on a left side of the body 101, as if the body 101 serves as a second LPG cylinder. Then, when the internal pressure of the body 101 is gradually lowered to a value equal to or less than and the pressure of the LPG cylinder, as the vaporized LPG is consumed, the check valve is re-opened to allow a small amount of liquid LPG to be introduced into the body 101. In this manner, the vaporizer is operable to supply fuel gas while repeatedly vaporizing the LPG. Thus, although a pressure of fuel gas to be sent from the pipe 105 is fluctuated, the pressure regulator can be provided on a downstream side of the pipe 105 to supply the fuel gas to the fuel-gas nozzle at a constant pressure. In the illustrated example, a base end of the pipe 105 serving as an outlet is disposed to slightly protrude into the internal space of the body to facilitate trapping the introduced liquid LPG in the internal space of the body.

One example of an installation position of this vaporizer is indicated in FIG. 5 which shows a part of the portable heat transfer apparatus according to the third embodiment. Specifically, the vaporizer body 101 is fixed to an outer surface of the venturi tube 37, and a leg member 101*a* extending from the vaporizer body 101 is disposed in adjacent relation to the heat-collecting container 38 to warm up LPG using heat released from the heat-collecting container 38.

Figure 12:
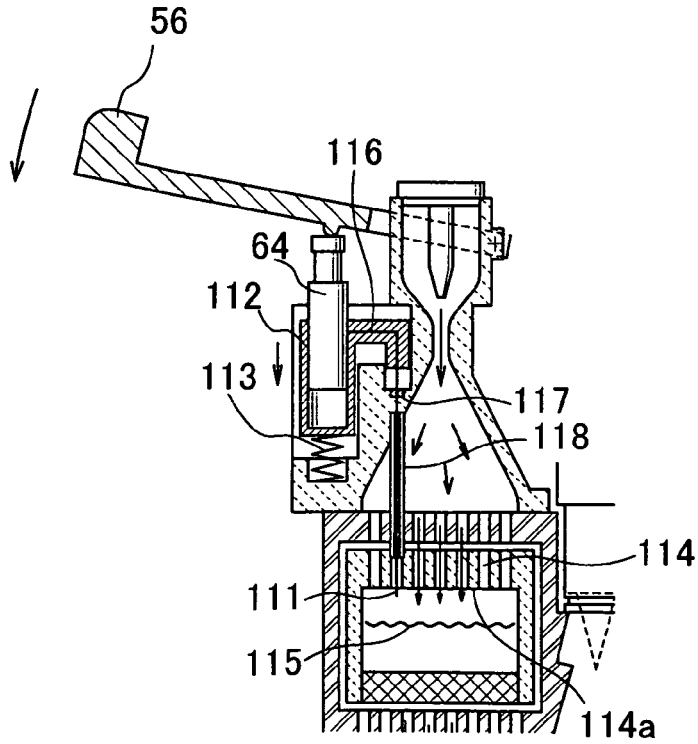
FIG. 12 is a fragmentary sectional view showing a principal part of a portable heat transfer apparatus according to a seventh embodiment of the present invention.

FIG. 12 shows a principal part of a portable heat transfer apparatus according to a seventh embodiment of the present invention. In a portable heat transfer apparatus, it is necessary to install a discharging electrode in a combustion chamber, for the purpose of ignition for inducing combustion in the combustion chamber defined inside the apparatus. The seventh embodiment shows another example of a layout of the discharge electrode.

Specifically, in FIG. 12, when a control lever 56 is pushed downwardly, a piezoelectric device 64 is also pushed downwardly by a leverage mechanism. The piezoelectric device 64 is housed in a holder 112 made of an electrical insulating material, and adapted to be moved upwardly and downwardly together with a discharging electrode 111. Before a start-up operation, the holder 112 is pushed upwardly by a spring 113. In this state, a distal end of the discharging electrode 111 is retracted inside a burner port 114 of a burner. A repulsion force of the spring 113 is set to be less than that of a built-in spring (not shown) of the piezoelectric device. Thus, when the control lever 56 is pushed downwardly, the holder 112 is firstly moved downwardly, and then the discharging electrode 111 is moved downwardly to protrude from a burner port surface 114*a*. When the control lever 56 is further pushed downwardly, the built-in spring of the piezoelectric device 64 is compressed, and sparks fly from the distal end of the discharging electrode 111 with a snapping sound to ignite a mixture. Subsequently, when a user releases his/her hand from the control lever 56, the piezoelectric device is returned to its original position by repulsion forces the built-in spring thereof and the spring 113, and simultaneously the distal end of the discharging electrode 111 is retracted inside the burner port 114.

As above, the mischarging electrode is disposed on an upstream side relative to a flame front. That is, during operation of the burner, the discharging electrode 111 is placed in a reduction atmosphere. This makes it possible to suppress oxidation of the discharging electrode 111 so as to provide enhanced durability thereof. In addition, the discharging electrode 111 is designed to be selectively advanced and retracted relative to the combustion chamber. This provides an advantage of being able to significantly suppress deterioration of the discharging electrode 111 due to combustion heat, and stabilize a flame front while preventing the discharging electrode 111 from disturbing a mixture flow. In FIG. 12, a lead wire 116 is provided as a means to lead electricity from the piezoelectric device 64 to the discharging electrode 111, and a sealing brush 117 is a rubber sealing adapted to prevent leakage of a mixture in a diffuser. An insulating tube 118 is provided as a means to prevent an unwanted electric discharge from occurring in an intermediate portion of the discharging electrode 111.

What is claimed is:

1. A portable heat transfer apparatus comprising:

a fuel-gas supply unit provided with an LPG supply source and a pressure regulator, and adapted to supply LPG as fuel gas;

a fuel gas-air air-fuel unit provided with a fuel-gas injection nozzle and a venturi tube each operable to operate with said fuel gas, and adapted to mix said fuel gas with air so as to provide a mixture thereof, said fuel gas-air air-fuel unit including an air-fuel ratio adjustment mechanism adapted to adjust an air-fuel ratio of said mixture during a start-up and warm-up period;

a piezoelectric ignition unit adapted to be activated by moving a control lever;

a burner adapted to subject said mixture to flame burning in a combustion chamber thereof;

a heat-collecting container disposed to surround said burner;

a heat-drive pump joined to said heat-collecting container, and adapted to transfer a liquid heated by heat generated in said burner, to a heat load via a liquid circuit; and a spring-type timer adapted to be moved by said control lever, wherein said air-fuel ratio adjustment mechanism is adapted to be moved in conjunction with said movement of said spring-type timer.

2. The portable heat transfer apparatus as defined in claim 1, which further comprises a safety unit including:

a safety valve provided in a fuel-gas flow passage;

means adapted to open said safety valve in conjunction with said spring-type timer during said start-up and warm-up period; and a mechanism adapted to close said safety valve through a temperature sensor adapted to become functional when said heat-collecting container is out of a predetermined temperature range.

3. The portable heat transfer apparatus as defined in claim 2, wherein said control lever includes an operating-force amplifying mechanism adapted to amplify an operating force for operating said piezoelectric ignition unit and/or said spring-type timer.

4. The portable heat transfer apparatus as defined in claim 2, which includes a vaporizer interposed in a fuel-gas flow passage connecting said LPG supply source and said pressure regulator, and adapted to forcedly vaporize said LPG by heat from said burner.

5. The portable heat transfer apparatus as defined in claim 2, wherein said combustion chamber of said burner has an internal volume of 10 cc or less.

6. The portable heat transfer apparatus as defined in claim 1, wherein said control lever includes an operating-force amplifying mechanism adapted to amplify an operating force for operating said piezoelectric ignition unit and/or said spring-type timer.

7. The portable heat transfer apparatus as defined in claim 1, which includes a vaporizer interposed in a fuel-gas flow passage connecting said LPG supply source and said pressure regulator, and adapted to forcedly vaporize said LPG by heat from said burner.

8. The portable heat transfer apparatus as defined in claim 7, which includes a porous solid radiation-conversion member installed in said combustion chamber, and adapted to partially convert heat energy into radiation energy.

9. The portable heat transfer apparatus as defined in claim 1, wherein said combustion chamber of said burner has an internal volume of 10 cc or less.

10. The portable heat transfer apparatus as defined in claim 1, which includes a porous solid radiation-conversion member installed in said combustion chamber, and adapted to partially convert heat energy into radiation energy.

11. The portable heat transfer apparatus as defined in claim 10, which includes an ignition-electrode advancing/retracting mechanism adapted, according to an operation of an operating lever, to advance an ignition electrode to protrude into said combustion chamber, and, after a discharging/igniting operation of said ignition electrode, return said ignition electrode to its original position outside said combustion chamber.

12. The portable heat transfer apparatus as defined in claim 1, which includes an ignition-electrode advancing/retracting mechanism adapted, according to an operation of an operating lever, to advance an ignition electrode to protrude into said combustion chamber, and, after a discharging/igniting operation of said ignition electrode, return said ignition electrode to its original position outside said combustion chamber.

13. The portable heat transfer apparatus as defined in claim 12, wherein said ignition electrode is disposed to be advanced and retracted at a position on an upstream side of a flow of said mixture relative to a flame front in said combustion chamber.

14. The portable heat transfer apparatus as defined in claim 1, wherein said control lever includes an operating-force amplifying mechanism adapted to amplify an operating force for operating said piezoelectric ignition unit and/or said spring-type timer.

15. A portable heat transfer apparatus comprising:

a fuel-gas supply unit provided with an LPG supply source and a pressure regulator, and adapted to supply gaseous LPG as fuel gas;

a fuel gas-air air-fuel unit provided with a fuel-gas injection nozzle and a venturi tube each operable to operate with said fuel gas, and adapted to mix said fuel gas with air so as to provide a mixture thereof, said fuel gas-air air-fuel unit including an air-fuel ratio adjustment mechanism adapted to adjust an air-fuel ratio of said mixture during a start-up and warm-up period;

a piezoelectric ignition unit adapted to be activated by moving a control lever;

a burner adapted to subject said generated mixture to flame burning in a combustion chamber thereof;

a heat-collecting container disposed to surround said burner;

a heat-drive pump joined to said heat-collecting container, and adapted to transfer a liquid heated by heat generated in said burner, to a heat load via a liquid circuit; and a temperature sensor installed in said heat-collecting container, and adapted to be activated in response to a temperature of said heat-collecting container, so as to move said air-fuel ratio adjustment mechanism.

16. The portable heat transfer apparatus as defined in claim 15, which further comprises a safety unit including:

a safety valve provided in a fuel-gas flow passage;

means adapted to open said safety valve in conjunction with said spring-type timer during said start-up and warm-up period; and a mechanism adapted to close said safety valve through a temperature sensor adapted to become functional when said heat-collecting container is out of a predetermined temperature range.

* * * * *